US005251693A

United States Patent [19]

Zifferer

[11] Patent Number: 5,251,693

[45] Date of Patent: Oct. 12, 1993

[54] TUBE-IN-SHELL HEAT EXCHANGER WITH LINEARLY CORRUGATED TUBING

[76] Inventor: Lothar R. Zifferer, P.O. Box 20688, Waco, Tex. 76702-0668

[21] Appl. No.: 962,661

[22] Filed: Oct. 19, 1992

[51] Int. Cl.[5] ..... F28D 7/00

[52] U.S. Cl. ..... 165/160; 165/177

[58] Field of Search ..... 165/1, 160, 177, 179, 165/910

[56] References Cited

U.S. PATENT DOCUMENTS 2,365,688 12/1944 Dewey ..... 165/177 X
3,330,336 7/1967 Göbel ..... 165/160
4,393,926 7/1983 Appel ..... 165/177 X

*Primary Examiner*—John C. Fox
*Attorney, Agent, or Firm*—Neal J. Mosely

[57] ABSTRACT

A tube-in-shell heat exchange apparatus is disclosed for passing two fluids in countercurrent linear heat exchange having a tubular shell, a pair of header caps closing opposite ends of the shell, a pair of tube plates positioned at the ends of the shell defining inlet and outlet headers with the header caps, the header caps having an inlet opening in one and an outlet opening in the other opening into the inlet and outlet headers, each tube plate having a plurality of spaced openings, a plurality of heat exchange tubes, one for each of tube plate opening, having opposite end portions reduced in diameter and increased in wall thickness and fitted and sealed in the tube plate openings, the tubes each having intermediate portions linearly corrugated or convoluted to provide equally spaced deep corrugations extending in a straight line parallel to the axis of the tubes and forming a plurality of linear flow passages, and the shell having an inlet opening at one end and an outlet opening at the other end inside the space between the tube plates, whereby one fluid may be passed from the header cap inlet through one header into and through the linearly corrugated tubes and out through the other header and the header cap outlet, and an other fluid may be passed through the shell inlet and the space between the linearly corrugated tubes and out through the shell outlet. The nesting of the tubes in the heat exchanger minimizes by-pass of the fluid and controls the velocity essential to achieving turbulent flow and attendant high rates of heat transfer. The attainable heat transfer per unit of length in relation to point size is extremely high with linearly corrugated or convoluted tubes.

29 Claims, 7 Drawing Sheets

TUBE-IN-SHELL HEAT EXCHANGER WITH LINEARLY CORRUGATED TUBING

FIELD OF THE INVENTION

This invention relates to new and useful improvements in tube-in-shell heat exchangers and more particularly to heat exchangers having linearly corrugated tubing with pointed, i.e., reduced diameter, ends which are substantially increased in wall thickness. Heat exchangers of this type are particularly useful in chilling water and in cooling oil with recirculating water as in motor vehicles.

BRIEF DESCRIPTION OF THE PRIOR ART

Tube-in-shell heat exchangers have been in use for many years. There have been many efforts to improve such heat exchangers, particularly for use in cooling water.

Dewey U.S. Pat. No. 2,365,688 discloses a tube-in-shell heat exchanger which groups or arranges the tubes for economical use of the available space and at the same time provides for an extended surface for heat exchange without blocking free circulation of a fluid between the tubes.

Donovan U.S. Pat. No. 2,797,554 discloses a tube-in-shell heat exchanger having longitudinally finned tubes extending through longitudinally extending tubes in the outer heat exchange shell.

Brown et al. U.S. Pat. No. 2,342,117 discloses a heat exchange tube having longitudinally extending fins secured thereon.

Brown U.S. Pat. No. 2,499,901 discloses a tube-in-shell heat exchanger with heat exchange tubes extending longitudinally therein with longitudinally extending heat exchange fins secured thereon.

Legrand U.S. Pat. No. 3,046,818 discloses a tube-in-tube heat exchanger with heat exchange tubes extending longitudinally in an outer tube with longitudinally extending heat exchange fins formed from the wails of the inner tubing.

Andersson U.S. Pat. No. 4,162,702 discloses a tube-in-shell heat exchanger with heat exchange tubes extending longitudinally therein with longitudinally extending heat exchange fins secured thereon, the space between the tubes and the shell being closed by filler material.

Shepherd et al U.S. Pat. No. 4,377,083 discloses the formation of helically corrugated tubing wherein tubing is drawn through a rotating die.

Zifferer U.S. Pat. No. 4,514,997 discloses the formation of helically corrugated tubing wherein tubing is drawn through a rotating die.

Singer U.S. Pat. No. 2,110,965 discloses a method of reducing the diameter of tubing by drawing it through a die.

Schmidt U.S. Pat. No. 2,378,729 discloses a method of reducing the diameter of and cold working magnesium alloy tubing by drawing it through a die.

Ceccacci U.S. Pat. No. 4,383,429 discloses an apparatus for forming a point on the end of a tube by means of a drawing operation which indents the reduced diameter peripherally.

SUMMARY OF THE INVENTION

One of the objects of this invention is to provide a new and improved tube-in-shell heat exchanger having improved heat exchange and improved fluid flow around the heat exchange tubes.

Another object of this invention is to provide a new and improved tube-in-shell heat exchanger having improved heat exchange and improved fluid flow around the heat exchange tubes in which the heat exchange tubes are linearly corrugated around the circumference of each tube.

Another object of this invention is to provide a new and improved tube-in-shell heat exchanger having improved heat exchange and improved fluid flow around the heat exchange tubes in which the heat exchange tubes are linearly corrugated around the circumference of each tube and which can be chemically cleaned but not mechanically cleaned because of the size of the passages.

Another object of this invention is to provide a new and improved tube-in-shell heat exchanger having improved heat exchange and improved fluid flow around the heat exchange tubes in which the heat exchange tubes are linearly corrugated around the circumference of each tube and have internal fins formed in the wall of the tube.

Another object of this invention is to provide a new and improved tube-in-shell heat exchanger having improved heat exchange and improved fluid flow around the heat exchange tubes in which the heat exchange tubes are linearly corrugated around the circumference of each tube which is particularly useful in chilling water and in cooling oil with recirculating water as in motor vehicles.

Still another object of this invention is to provide a new and improved tube-in-shell heat exchanger having improved heat exchange and improved fluid flow around the heat exchange tubes in which the heat exchange tubes are pointed, i.e., reduced in diameter and correspondingly increased in wall thickness, and the intermediate body portion linearly corrugated around the circumference of each tube.

Still another object of this invention is to provide a new and improved tube-in-shell heat exchanger having improved heat exchange and improved fluid flow around the heat exchange tubes in which the heat exchange tubes are pointed, i.e., reduced in diameter and correspondingly increased in wall thickness, and the intermediate body portion linearly corrugated around the circumference of each tube to provide uniformly spaced hollow heat exchange fins or flow passages extending linearly of each tube.

Still another object of this invention is to provide a new and improved tube-in-shell heat exchanger having improved heat exchange and improved fluid flow around the heat exchange tubes in which the heat exchange tubes are linearly corrugated around the circumference of each tube to provide uniformly spaced hollow heat exchange fins or passages extending linearly of each tube.

Still another object of this invention is to provide a new and improved tube-in-shell heat exchanger having improved heat exchange and improved fluid flow around the heat exchange tubes in which the shell has tube plates defining inlet and outlet chambers at each end and the tubes have their opposite ends pointed, i.e., reduced in diameter and correspondingly increased in wall thickness, secured in the plates, the shell having inlet and outlet connections for circulating a fluid in heat exchange relation with and linearly of the tubes.

Yet another object of this invention is to provide a new and improved tube-in-shell heat exchanger having improved heat exchange and improved fluid flow around the heat exchange tubes in which the shell has tube plates defining inlet and outlet chambers at each end and the tubes have their opposite ends pointed, i.e., reduced in diameter and correspondingly increased in wall thickness, secured in the plates, in which the heat exchange tubes are linearly corrugated around the circumference of each tube, and the shell having inlet and outlet connections for circulating a fluid in heat exchange relation with and linearly of the tubes.

Yet another object of this invention is to provide a new and improved tube-in-shell heat exchanger having improved heat exchange and improved fluid flow around the heat exchange tubes in which the shell has tube plates defining inlet and outlet chambers at each end and the tubes have their opposite ends pointed, i.e., reduced in diameter and correspondingly increased in wall thickness, secured in the plates, in which the heat exchange tubes are linearly corrugated around the circumference of each tube to provide uniformly spaced hollow heat exchange fins extending linearly of each tube, the shell having inlet and outlet connections for circulating a fluid in heat exchange relation with and linearly of the tubes.

A further object of this invention is to provide a new and improved tube-in-shell heat exchanger having improved heat exchange and improved fluid flow around the heat exchange tubes in which the heat exchange tubes are pointed, i.e., reduced in diameter and correspondingly increased in wall thickness, and the intermediate body portion linearly corrugated around the circumference of each tube to provide a plurality of linear tubes defined by the corrugations and by the spacing of the corrugated tubes which nest together in a geometric, e.g., square or hexagonal, pattern.

A further object of this invention is to provide a new and improved tube-in-shell heat exchanger having improved heat exchange and improved fluid flow around the heat exchange tubes in which the heat exchange tubes are pointed, i.e., reduced in diameter and correspondingly increased in wall thickness, and the intermediate body portion linearly corrugated around the circumference of each tube to provide a plurality of linear tubes defined by the corrugations and by the spacing of the corrugated tubes which nest together in a geometric, e.g., square or hexagonal, pattern which is particularly useful in chilling water and in cooling oil with recirculating water as in motor vehicles.

A further object of this invention is to provide a new and improved tube-in-shell heat exchanger having improved heat exchange and improved fluid flow around the heat exchange tubes in which the heat exchange tubes are pointed, i.e., reduced in diameter and correspondingly increased in wall thickness, and the intermediate body portion linearly corrugated around the circumference of each tube, with linear spacer elements sealing the space along adjacent tubes, the corrugation and the linear spacers providing a plurality of linear tubes for improved heat exchange.

Other objects of the invention will become apparent from time to time throughout the specification and claims as hereinafter related.

DESCRIPTION OF ONE PREFERRED EMBODIMENT

Figure 1:
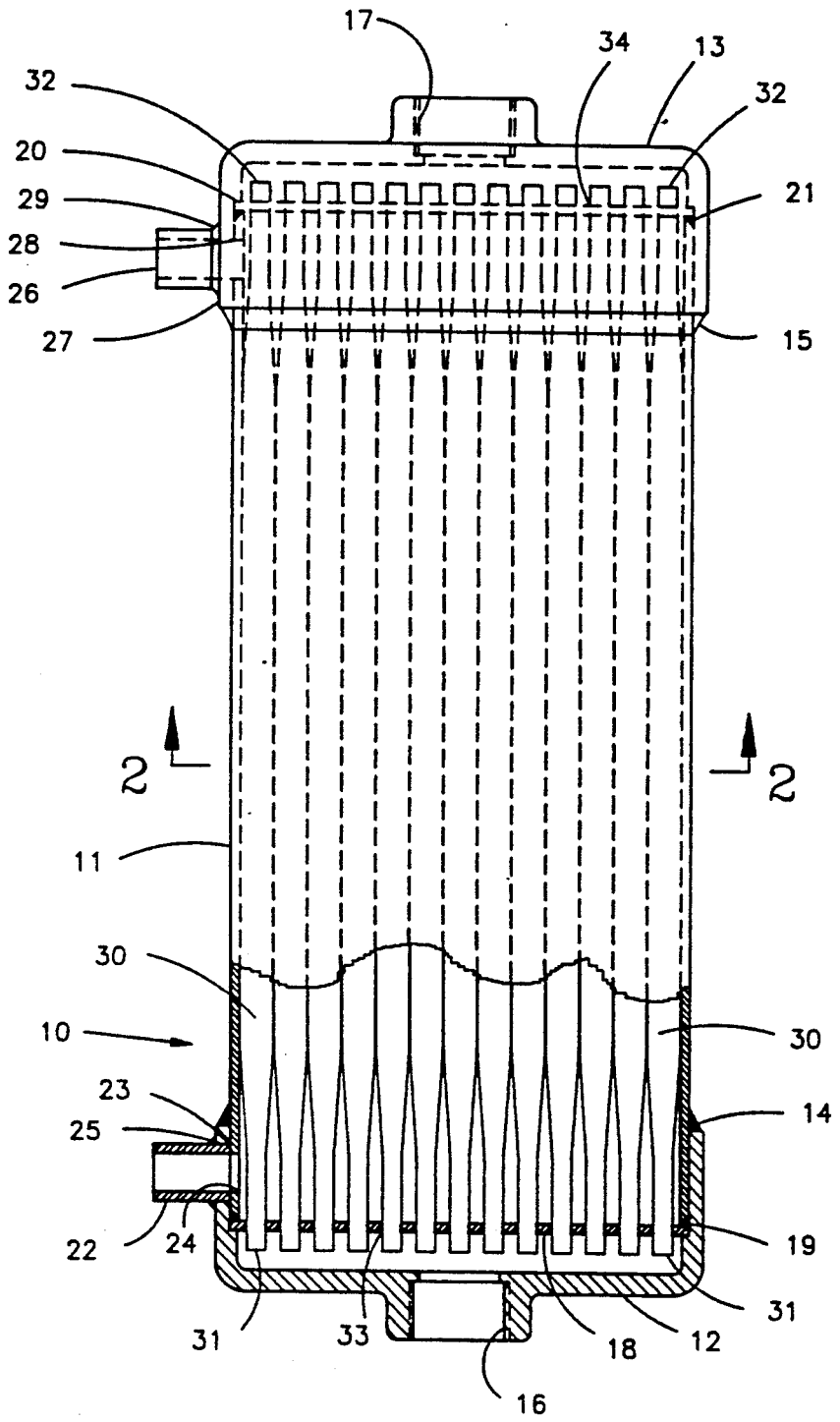
FIG. 1 is a view in elevation and partially broken section of an improved tube-in-shell heat exchanger illustrating a preferred embodiment of the invention.

This invention relates to new and useful improvements in heat exchangers which are particularly efficient for cooling water. In FIG. 1, there is shown an improved tube-in-shell heat exchanger 10 having a hollow tubular shell 11 with header plates (or caps) 12 and 13 welded or brazed thereon as indicated at 14 and 15. Header plate 12 has an inlet opening 16 and header plate 13 has an outlet opening 17 for conducting water (or other fluid) therethrough. Tube plate 18 is welded or brazed to the inlet end of shell 11 as indicated at 19. Tube plate 20 is welded or brazed to the outlet end of shell 11 as indicated at 21.

A refrigerant outlet tube 22 is positioned in an opening 23 in header inlet plate (or cap) 12 and aligned with an opening 24 in the wall of tube shell 11. Outlet tube 22 is welded or brazed to inlet header plate 12 as indicated at 25. A refrigerant inlet tube 26 is positioned in an opening 27 in header outlet plate (or cap) 13 and aligned with an opening 28 in the wall of tube shell 11. Inlet tube 26 is welded or brazed to outlet header plate 13 as indicated at 29.

Figure 3:
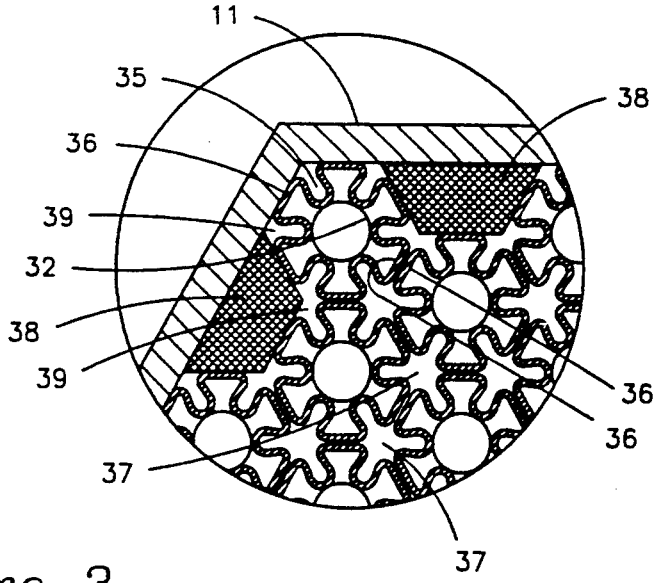
FIG. 3 is a detail, enlarged section of the circled portion 3 of FIG. 2.
Figure 4:
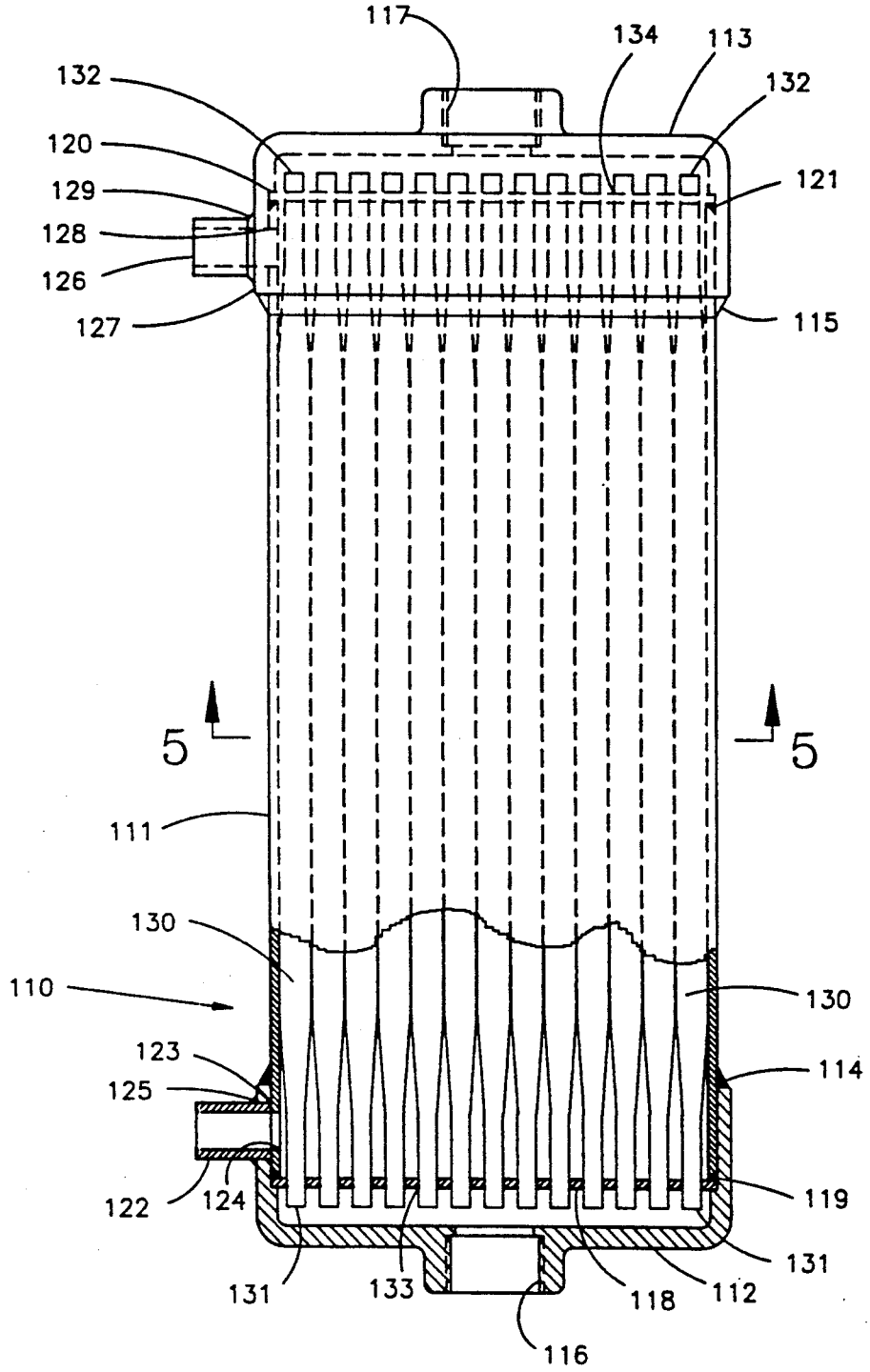
FIG. 4 is a view in elevation and partially broken section of an improved tube-in-shell heat exchanger illustrating another embodiment of the invention.

A plurality of heat exchange tubes 30 are positioned inside the shell 11 between tube plates 18 and 20. Tubes 30 have opposite ends 31 and 32 of substantially reduced diameter and correspondingly increased wall thickness (produced by a tube pointer) which fit into and through openings 33 and 34 in tube plates 18 and 20. The reduced diameter, thickened, tube ends 31 and 32 are brazed on tube plates 18 and 20 to provide a fluid-tight, leakproof, connection therein. The intermediate body portion of tubes 30, between reduced end portions 31 and 32 are linearly corrugated as shown in FIGS. 3 and 4, and described below.

Figure 2:
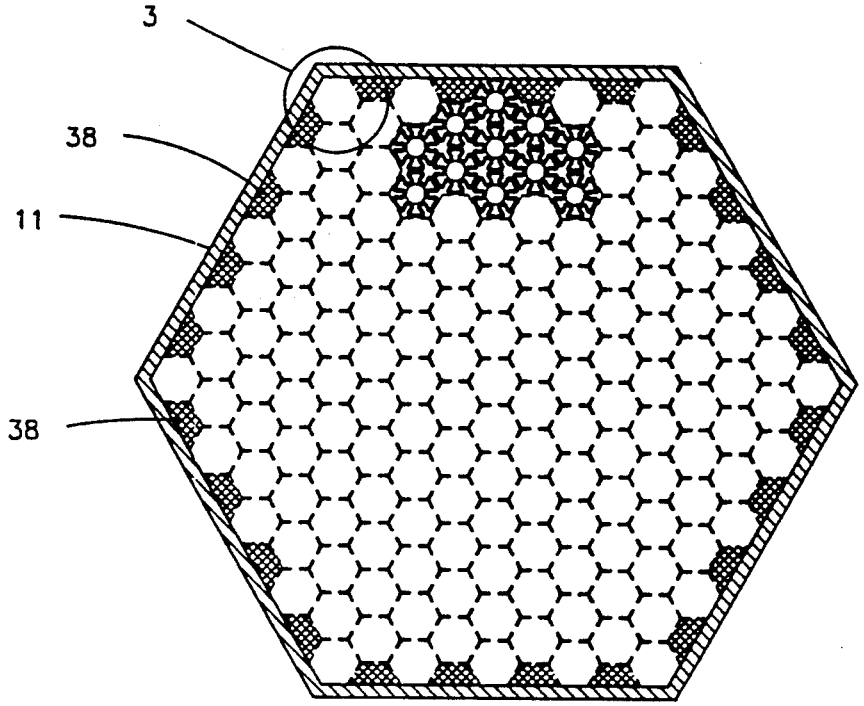
FIG. 2 is a view in cross section taken on the line 2—2 of FIG. 1 of the improved tube-in-shell heat exchanger comprising a preferred embodiment of the invention.
Figure 5:
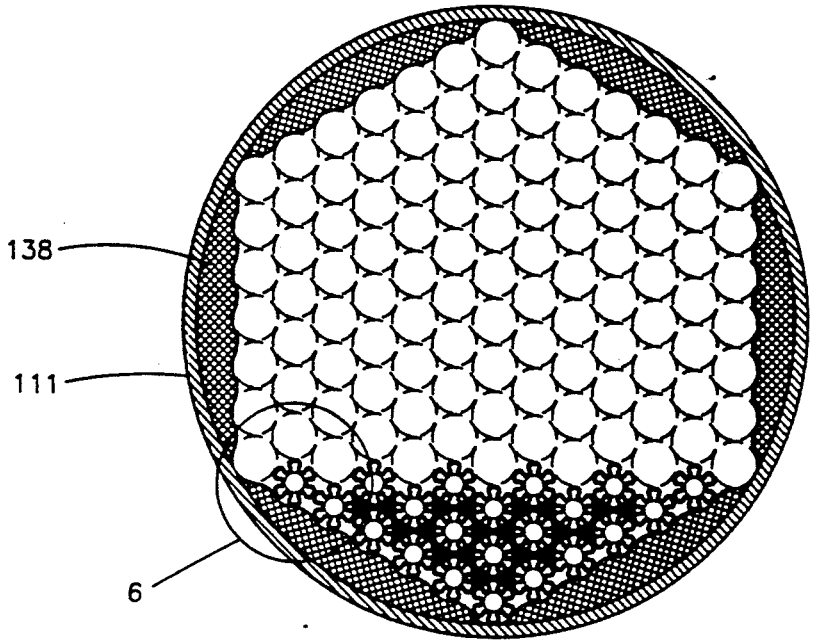
FIG. 5 is a is a view in cross section taken on the line 5—5 of FIG. 4 of the improved tube-in-shell heat exchanger wherein the shell of a different shape.

Tube shell 11 (and header plates 12 and 13, and tube plates 18 and 20) are of the same shape and may be polygonal, e.g., hexagonal (FIG. 2) or square (FIG. 10), or circular (FIG. 5). In the embodiment of FIGS. 2 and 3, shell 11, header plates or caps 12 and 13, and tube plates 18 and 20 are hexagonal. Heat exchange tubes 30 have six linear, parallel corrugations 35 extending for the entire length of the enlarged portion of the tubes between the reduced end portions 31 and 32.

The corrugated tubes 30 are produced, by the method described in my copending application Ser. No. 07/962,660, filed Sep. 10, 1992, wherein a cylindrical tubing of sufficient size has its end portions reduced in diameter to a desired smaller size (ends 31 and 32) and correspondingly increased in wall thickness by passing into a reducing die, also known as a tube pointer. For example, a 1.187" O.D. tube having a wall thickness of 0.020" which has its end portion 15 reduced to 0.375" O.D. will have a wall thickness of 0.055" while the main body 16 of the tube remains unchanged at a wall thickness of 0.020" with portion 17 tapering in wall thickness. The heavier wall thickness of the ends 15 increases the integrity of the joint when the ends are assembled in tube sheets in a tube-in-shell heat exchanger.

Figure 8:
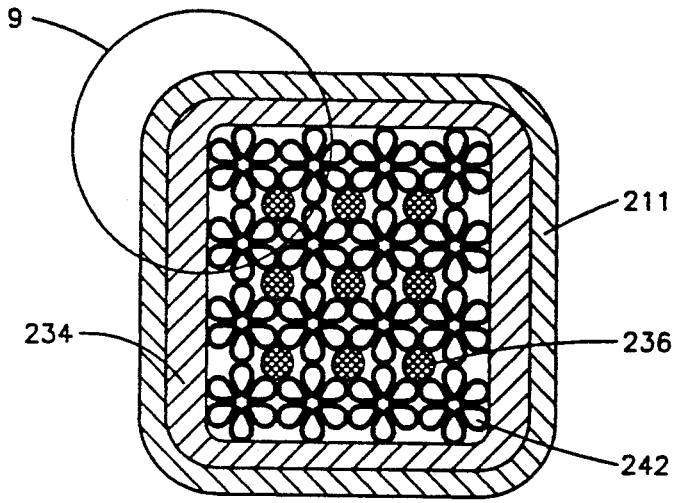
FIG. 8 is a view in cross section taken on the line 8—8 of FIG. 7 of the improved tube-in-shell heat exchanger wherein the shell of a different shape and the deep corrugations of the tubes is emphasized.
Figure 10:
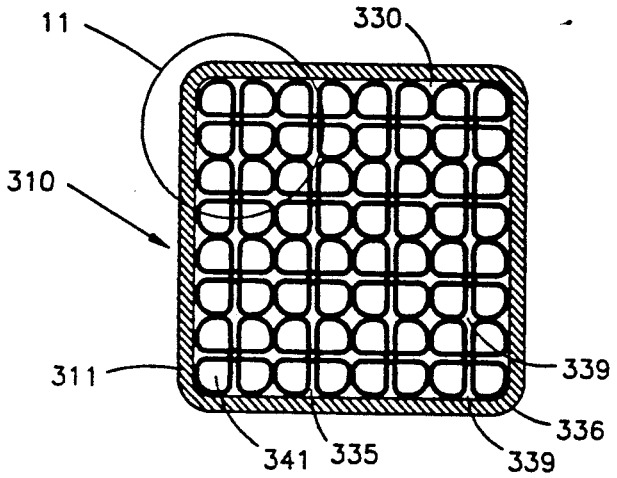
FIG. 10 is a is a view in cross section of the improved tube-in-shell heat exchanger wherein the shell is of square cross section (with rounded corners) and the tubes are corrugated with four lobes or corrugations and nest in a square pattern without filler strips to prevent cross circulation.

The tube, which has been reduced in diameter and increased in wall thickness at each end, is then pushed or pulled through a corrugating die having angularly spaced die teeth which are shaped to progressively indent the wall of the tube at equally spaced points around the tube which gradually and progressively indents the tubing wall until the corrugations are about tangential to the I.D. of the end openings 31 and 32 or, if desired, can extend substantially inside the I.D. of the ends (FIGS. 8 and 10).

It is to be noted that while the tube pointing operation increases the wall thickness of the ends, the convolution of the tube wall does not thicken it. The convoluting rearranges the metal in a folding operation while the pointing operation is an extrusion type of metal displacement in which both wall thickening and length extrusion of the point occur.

In this embodiment, the outer walls 36 of the tubes are nearly flat and substantially hexagonal so that the tubes have walls 36 nested together when the ends 31 and 32 are secured in tube plates 18 and 20. The nesting tubes 30 define linear passages 37. The outermost tubes 30 abut the inner wall surface of shell 11. Fill strips 38 of suitable material, e.g., plastic, rubber or the like, fill the spaces between the tubes 30 which do not abut the wall surface of shell 11 and define linear passages 39 along the outside of the tube bundle. This embodiment was described as having a shell and interior construction of hexagonal shape. Other regular, polygonal, especially square, shapes have been found to work with similar efficiency and ease of construction. The use and operation of this embodiment of the improved heat exchanger and other embodiments will described below.

A SECOND EMBODIMENT

Figure 6:
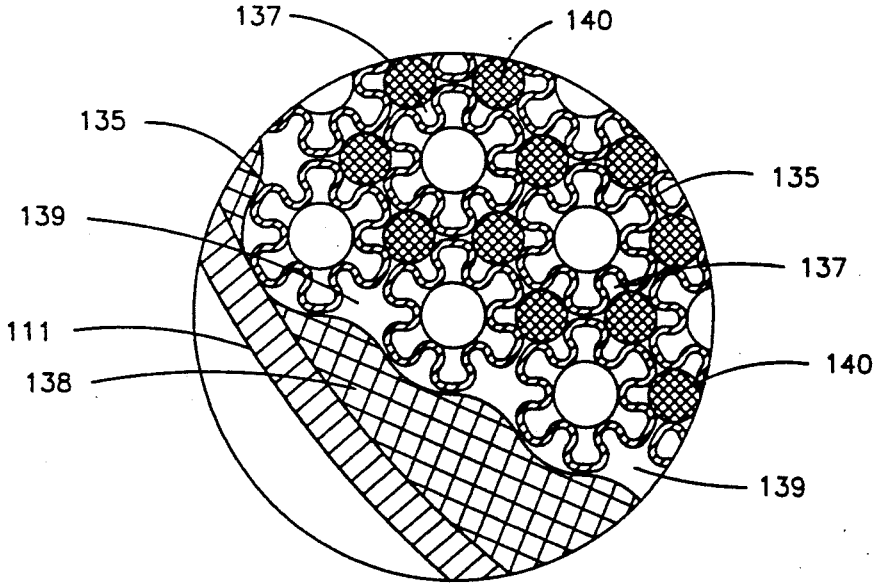
FIG. 6 is a detail, enlarged section of the circled portion 6 of FIG. 5.

In FIGS. 4–6, there is shown another embodiment of the heat exchanger where the tube shell is of a different shape and other modifications are made. The numbering used will be the numbers used in FIGS. 1–3 raised by one hundred. The description of FIGS. 1–3 will not be repeated fully to avoid repetition.

FIG. 4, there is shown another embodiment of my improved tube-in-shell heat exchanger 110 having a hollow tubular shell 111 with header plates (or caps) 112 and 113 welded or brazed thereon as indicated at 114 and 115. Header plate 112 has an inlet opening 116 and header plate 113 has an outlet opening 117 for conducting water (or other fluid) therethrough. Tube plate 118 is welded or brazed at 119 to the inlet end of shell 111. Tube plate 120 is welded or brazed at 121 to the outlet end of shell 111.

A refrigerant outlet tube 122 in opening 123 in header inlet plate (or cap) 112 is aligned with opening 124 in the wall of tube shell 111. Outlet tube 122 is welded or brazed at 125 to inlet header plate 112. A refrigerant inlet tube 126 in opening 127 in header outlet plate (or cap) 113 is aligned with opening 128 in the wall of tube shell 111. Inlet tube 126 is welded or brazed at 129 to outlet header plate 113.

Heat exchange tubes 130 inside shell 111 extend between tube plates 118 and 120. Tubes 130 have opposite ends 131 and 132 of substantially reduced diameter and correspondingly increased wall thickness (produced by a tube pointer) which fit into and through openings 133 and 134 in tube plates 118 and 120. The reduced diameter, thickened, tube ends 131 and 132 are brazed on tube plates 118 and 120 to provide a fluid-tight, leakproof, connection therein. The intermediate body portion of tubes 130, between reduced end portions 131 and 132 are linearly corrugated as shown in FIGS. 5 and 6, and described below.

Tube shell 111 (and header plates 112 and 113, and tube plates 118 and 120) are circular in shape. Heat exchange tubes 130 have six linear, parallel corrugations 135 extending for the entire length of the enlarged portion of the tubes between the reduced end portions 131 and 132. The corrugated tubes 130 are produced as described above.

In this embodiment, the outer walls 136 of the tubes are not necessarily flat and walls 136 do not nest tightly together when the ends 131 and 132 are secured in tube plates 118 and 120. Fill strips 138 of suitable material, e.g., plastic, rubber or the like, fill the spaces between the outermost tubes 130 and define linear passages 139 along the outside of the tube bundle. Fill strips 140 of suitable material, e.g., plastic, rubber or the like, fill the spaces between adjacent tubes 130 and define linear passages 137 along the corrugations in each of the tubes 130.

A THIRD EMBODIMENT

Figure 7:
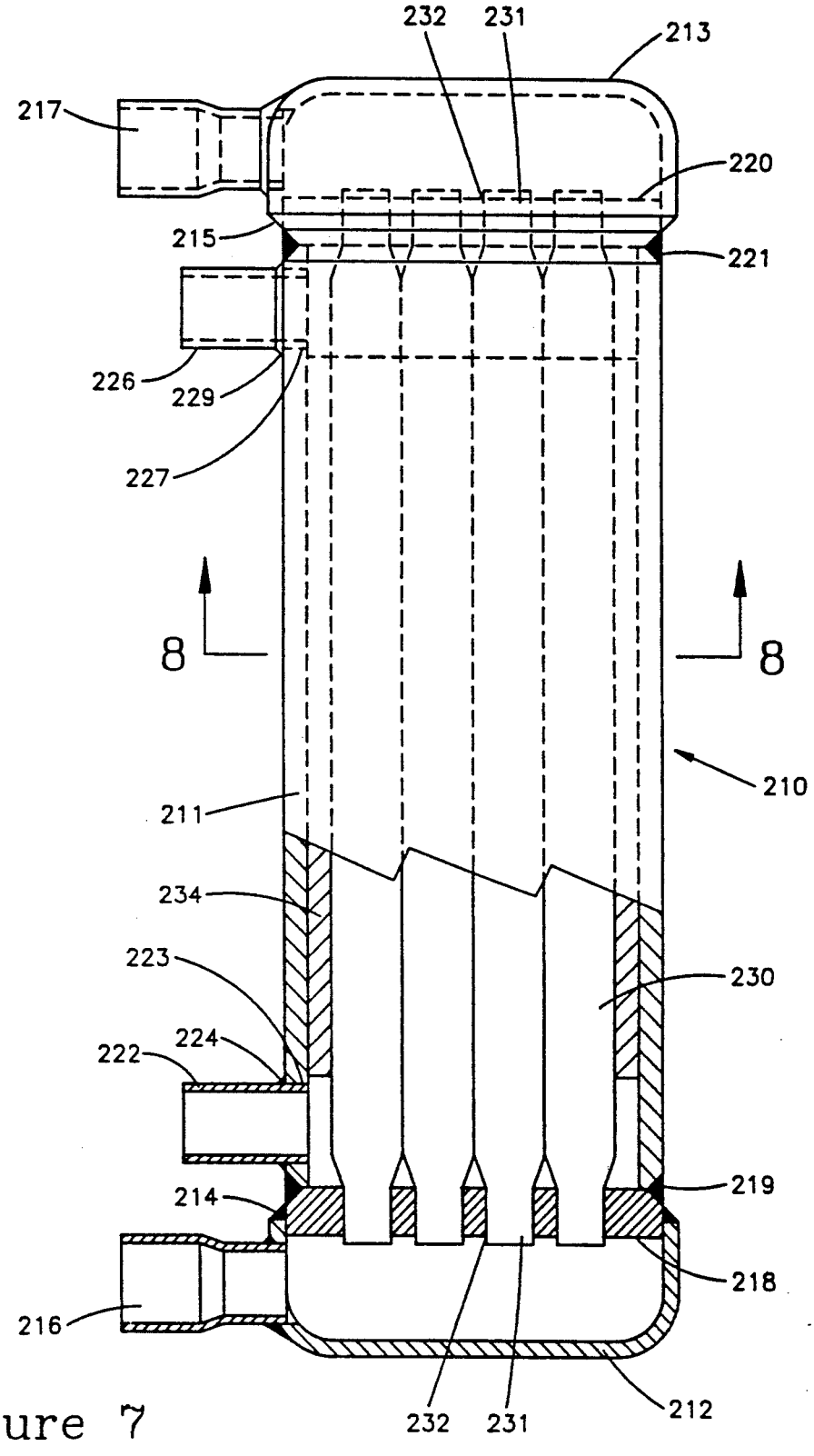
FIG. 7 is a view in elevation and partially broken section of an improved tube-in-shell heat exchanger illustrating another embodiment of the invention in which the depth of the linear corrugations of the tubes provides a plurality of smaller, linear heat exchange tubes.
Figure 9:
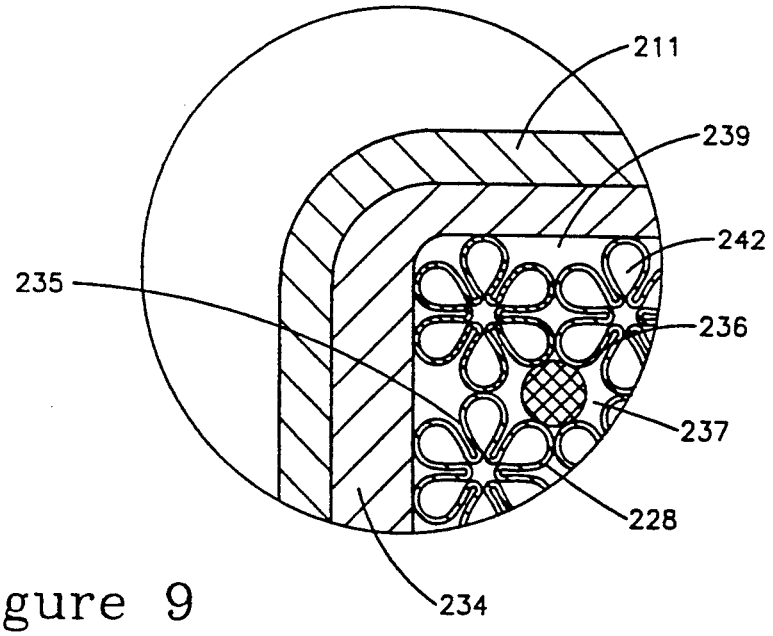
FIG. 9 is a detail, enlarged section of the circled portion 9 of FIG. 8.

In FIGS. 7–9, there is shown another embodiment of the heat exchanger where the tube shell is substantially square in cross section and the linear tube corrugations are more severe. The numbering used will be the numbers used in FIGS. 1–3 raised by two hundred.

The description of FIGS. 1–3 will not be repeated fully to avoid repetition.

In FIG. 7, there is shown another embodiment of my improved tube-in-shell heat exchanger 210 having a hollow tubular shell 211 with header plates (or caps) 212 and 213 welded or brazed thereon as indicated at 114 and 115. Header plate 112 has a side inlet opening 216 and header plate 113 has a side outlet opening 217 for conducting water (or other fluid) therethrough.

Tube plate 218 is welded or brazed at 219 to the inlet end of shell 211. Tube plate 220 is welded or brazed at 221 to the outlet end of shell 211.

A refrigerant outlet tube 222 in opening 223 in tube shell 211 is welded or brazed in place as shown at 224. A refrigerant inlet tube 226 in opening 227 in tube shell 211 is welded or brazed in place as shown at 229.

Heat exchange tubes 230 inside shell 211 extend between tube plates 218 and 220. Tubes 230 have opposite ends 231 and 232 of substantially reduced diameter and correspondingly increased wall thickness (produced by a tube pointer) which fit into and through openings 233 and 234 in tube plates 218 and 220. Tube ends 231 and 232 are brazed on tube plates 218 and 220 to provide a fluid-tight, leakproof, connection therein. The intermediate body portion of tubes 230, between reduced end portions 231 and 232 are linearly corrugated as shown in FIGS. 8 and 9, and described below.

Tube shell 211 (and header plates 212 and 213, and tube plates 218 and 220) are square in shape with rounded corners. Heat exchange tubes 230 have six linear, parallel corrugations 235 extending for the entire length of the enlarged portion of the tubes between the reduced end portions 231 and 232. The corrugated tubes 230 are produced as described for FIGS. 1-3 above.

In this embodiment, the outer walls 236 of the tubes are round and substantially touch (see FIGS. 9) when the ends 231 and 232 are secured in tube plates 218 and 220. A filler material 234 of suitable material, e.g., plastic, rubber or the like, fill the spaces between the outermost tubes 230 and define linear passages 239 along the outside of the tube bundle. Fill strips 240 of suitable material, e.g., plastic, rubber or the like, fill the spaces between adjacent tubes 130 and define linear passages 237 along the corrugations in each of the tubes 230. The very deep corrugations 235 define a plurality of linear tubes 241 spaced around each of the tubes 230.

A FOURTH EMBODIMENT

Figure 11:
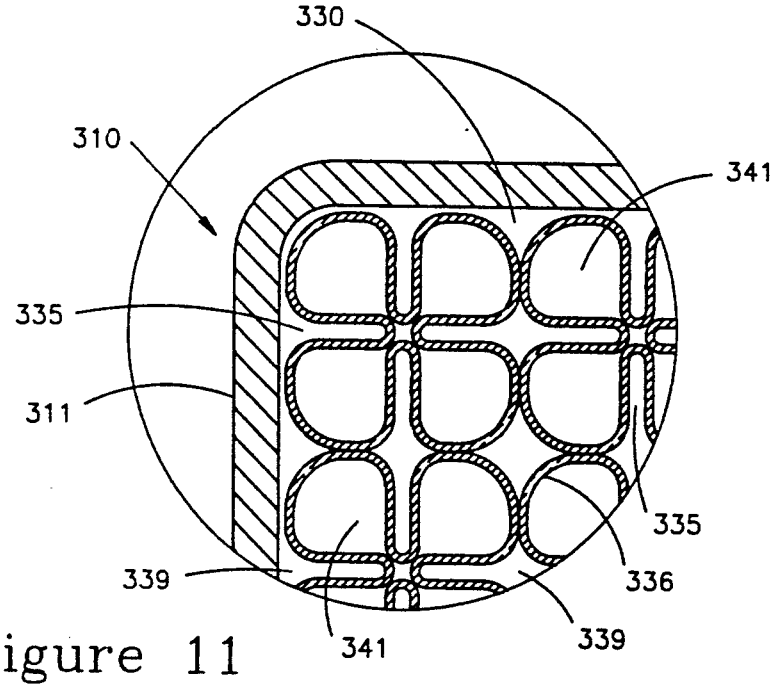
FIG. 11 is a detail, enlarged section of the circled portion of FIG. 10.

In FIGS. 10-11, there is shown another embodiment of the heat exchanger where the tube shell is substantially square in cross section and the linear tube corrugations are more severe and four in number. The parts numbering used will be the numbers used in FIGS. 1-3 raised by three hundred. However, only the sections of the tubes and the heat exchange shell are shown since the length of the apparatus, the headers, the tube plates, etc are as in FIG. 7.

In FIG. 10, there is shown another embodiment of my improved tube-in-shell heat exchanger 310 having a hollow tubular shell 311 with header plates, side inlet and outlet openings for conducting water (or other fluid) therethrough, tube plates, etc. as in FIG. 7.

Heat exchange tubes 330 inside shell 311 extend between the tube plates with their opposite ends of substantially reduced diameter and correspondingly increased wall thickness fit into and through openings in the tube plates. The intermediate body portions of the tubes 330, between the reduced end portions are linearly corrugated as shown in FIGS. 10 and 11, and described below.

Tube shell 311 (and the header plates and tube plates) are square in shape with rounded corners. Heat exchange tubes 330 have four linear, parallel corrugations 335 extending for the entire length of the enlarged portion of the tubes between the reduced end portions. The corrugated tubes 330 are produced as described for FIGS. 1-3, and 7-9 above but have four corrugations and nest in a square pattern.

In this embodiment, the outer walls 336 of the tubes are round, but have four corrugations, and nest tightly (see FIGS. 10-11) when the ends are secured in the tube plates. No filler material is required since the tubes are tightly nested. The spaces around the corrugations define linear passages 339 along the outside of the tube bundle. The very deep corrugations 335 define a plurality of linear tubes 341 spaced around each of the tubes 330.

OPERATION

The ideal shell and tube heat exchanger would have the largest number of smallest tubes (but larger than capillary size) that can be expanded and sealed into a tube sheet. This ideal heat exchanger would eliminate the need for baffles to control flow at right angles to the tubes. However, there is a practical limit to downsizing tubes because of the labor to install, expand and seal the tubes.

The tubes 30 effectively multiply, by means of the lobes 36 (corrugations), which are equivalent to tubes, the amount of heat transfer attainable from the point diameter selected for attachment to the tube sheets. It also makes possible the contiguous relation of each tube to the surrounding tubes. The nesting of the tubes in the heat exchanger minimizes by-pass of the fluid and controls the velocity essential to achieving turbulent flow and attendant high rates of heat transfer.

The heavy wall point and thin wall of the heat transfer tube are unique features which contribute importantly to the economy of materials used in this type of heat exchanger. The attainable heat transfer per unit of length in relation to point size is extremely high with linearly convoluted tubes.

As an example: A 1.187" diameter tube can be pointed to 0.375" diameter and the main body of the tube convoluted to 0.562" diameter. These tubes are nested in contact with each other to maximize the total area available for heat transfer. Whereas a conventional tube point is equal to the tube diameter for a 1:1 ratio. The ratio of the tube to the point is the design just described is 3.16:1, although ratios in the range from about 1.5:1 to 4:1 are effective.

The apparatus, as described for the four embodiments above, is designed as a water chiller or cooler for cooling large quantities of flowing water or for cooling oil with recirculating water as in motor vehicles.. The heat exchange apparatus 10, 110, 210 or 310 is connected in a water line with water entering inlet 16, 116 or 216 and exiting from outlet 17, 117 or 217. The water is confined at the inlet end by tube plate 18, 118 or 218 to flow through the interior of tubes 30, 130 and 230. As noted above, the I.D. of tubes (FIGS. 1-6) inside the innermost projection of corrugations 35 or 135 is about the same is the I.D. of the reduced (or pointed) end portions 31 and 32 (or 131 and 132). In the embodiment of FIGS. 7-9 and 10-11, the corrugations are so deep that they touch each other and define a plurality of small linear tubes spaced peripherally around each of the tubes 230, 330.

The apparatus is also connected in a refrigeration system and constitutes the evaporator for the system. Liquified refrigerant enters through inlet 26, 126 or 226, flows through passages 37, 137 or 237 and 39, 139 or 139 as it evaporates and exits through outlet 22, 122 or 222. Alternatively, the refrigeration system may cool a secondary refrigerant fluid at another location and circulate it through this water chiller. In either case, the expanding refrigerant gas or the cooled secondary refrigerant liquid is circulated countercurrently to the flow of water which is being cooled. The water flow is at a relatively high rate an under turbulent flow conditions. The design capacity of several units built and tested was 40 tons of refrigeration. The apparatus can be used similarly to pass water or other coolant in heat exchange with the oil in a motor vehicle engine.

If a tube-in-shell heat transfer device is defined by the area and length of the shell structure which contains it, it is seen that the cubic volume of the device just described is 1/3.16 or 28% of a conventional structure. It is possible to improve the heat exchanger further by producing internal fins, as in U.S. Pat. No. 3,118,328, prior to linear convolution of the tubes. Along with the functional advantages, there is an additional non-functional advantage which results from the unique structure of this invention which is of considerable importance. U.L. (Underwriters Laboratories) certification is required for heat exchangers of 6" I.D. or 1.5 cu. ft. of total contained volume. Within the U.L. constraints and not requiring U.L certification, the present apparatus makes possible up to 40 ton condensers. Bypassing the U.L. certification results in substantial manufacturing economies which are additive with the economics realized in the material requirements of the apparatus. The 28% of conventional cube volume relates to smaller systems possible with the use of this heat exchanger. These smaller systems save freight and installation costs and give a marketing advantage over larger functionally equivalent systems. The small size and high capacity makes this heat exchanger especially useful for passing hot engine oil in a motor vehicle in heat exchange with water or other coolant. A minor disadvantage to this heat exchanger is that the small corrugations make it difficult, if not impossible, to clean mechanically. However, this disadvantage is slight inasmuch as the tubes can be cleaned chemically.

While this invention has been described fully and completely with special emphasis on certain preferred embodiments, it should be understood that within the scope of the appended claims the invention may be practiced otherwise than as specifically described.

I claim:

1. A tube-in-shell heat exchange apparatus for passing two fluids in countercurrent linear heat exchange comprising a tubular shell closed on opposite ends, a pair of tube plates positioned at the ends of said shell and defining inlet and outlet headers at said tubular shell closed ends, said closed ends having an inlet opening in one and an outlet opening in the other opening into the respective inlet and outlet headers, each of said tube plates having a plurality of openings spaced in a predetermined manner, a plurality of heat exchange tubes, one for each of said tube plate openings, of a size substantially larger than said tube plate openings and having opposite end portions reduced in diameter and correspondingly increased in wall thickness fitted and sealed in said tube plate openings, said tubes each having the portion intermediate said reduced end portions linearly corrugated to provide a plurality of equally spaced deep corrugations extending in a straight line parallel to the axis of said tubes, and said shell having an inlet opening at one end and an outlet opening at the other end inside the space between said tube plates, whereby one fluid may be passed from said closed end inlet through said linearly corrugated tubes and out through the said closed end outlet, and another fluid may be passed through said shell inlet and the space between said linearly corrugated tubes and out through said shell outlet.

2. An apparatus according to claim 1 in which said shell closed ends comprise a pair of header caps closing opposite ends of said shell, and said closed end inlet opening and outlet opening are in said header caps.

3. An apparatus according to claim 1 in which said heat exchange tubes are corrugated to a depth corresponding to about the I.D. of said reduced-diameter, thickened-wall, end portions.

4. An apparatus according to claim 1 in which said heat exchange tubes are corrugated to a depth where the corrugations touch and define a plurality of smaller tubes spaced peripherally around and extending linearly of each tube.

5. An apparatus according to claim 4 including means for preventing fluid flow laterally around or across said tubes and confining fluid flow to a direction linearly of said tubes.

6. An apparatus according to claim 4 in which said tubes are tightly nested to prevent fluid flow laterally around or across said tubes and confining fluid flow to a direction linearly of said tubes.

7. An apparatus according to claim 5 in which said fluid flow preventing and confining means comprises a plurality of fill strips positioned adjacent to said tube corrugations and extending longitudinally thereof.

8. An apparatus according to claim 1 in which said shell is polygonal in cross section.

9. An apparatus according to claim 8 in which said shell is hexagonal in cross section.

10. An apparatus according to claim 9 in which said tubes are corrugated along six equally spaced lines, and said corrugated tubes fit together in hexagonal nesting relation.

11. An apparatus according to claim 8 in which said shell is substantially square in cross section.

12. An apparatus according to claim 11 in which said tubes are corrugated along four equally spaced lines, and said corrugated tubes fit together in tightly abutting square relation.

13. An apparatus according to claim 1 in which said shell is circular in cross section.

14. An apparatus according to claim 1 including means for preventing fluid flow laterally around or across said tubes and confining fluid flow to a direction linearly of said tubes.

15. An apparatus according to claim 14 in which said fluid flow preventing and confining means comprises a plurality of fill strips positioned adjacent to said tube corrugations and the inner surface of the wall of said shell and extending longitudinally of said corrugations.

16. An apparatus according to claim 14 including means for preventing fluid flow laterally around or across said tubes and confining fluid flow to a direction linearly of said tubes.

17. An apparatus according to claim 16 in which said fluid flow preventing and confining means comprises a plurality of fill strips positioned adjacent to said tube corrugations and the inner surface of the wall of said shell and between adjacent corrugations of said tubes and extending longitudinally of said corrugations.

18. An apparatus according to claim 1 in which said tubes are corrugated along six equally spaced lines, and said corrugated tubes fit together in hexagonal relation spaced a predetermined distance from each other.

19. An apparatus according to claim 1 in which said heat exchange tubes are corrugated to a depth corresponding to about or less than the I.D. of said reduced diameter end portions, and including means for preventing fluid flow laterally around or across said tubes and confining fluid flow to a direction linearly of said tubes, said fluid flow preventing and confining means comprising a plurality of fill strips positioned adjacent to said tube corrugations and extending longitudinally thereof.

20. An apparatus according to claim 19 in which said shell is polygonal or circular in cross section.

21. An apparatus according to claim 19 in which said shell is hexagonal in cross section.

22. An apparatus according to claim 19 in which said tubes are corrugated along six equally spaced lines, and said corrugated tubes fit together in hexagonal nesting relation.

23. An apparatus according to claim 22 in which said fluid flow preventing and confining means comprises a plurality of fill strips positioned adjacent to said tube corrugations and the inner surface of the wall of said shell and extending longitudinally of said corrugations.

24. An apparatus according to claim 19 in which said tubes are corrugated along six equally spaced lines, and said corrugated tubes fit together in hexagonal relation spaced a predetermined distance from each other.

25. An apparatus according to claim 24 in which said fluid flow preventing and confining means comprises a plurality of fill strips positioned adjacent to said tube corrugations and the inner surface of the wall of said shell and also between adjacent corrugations of said tubes and extending longitudinally of said corrugations.

26. An apparatus according to claim 1 in which said heat exchange tubes are corrugated to a depth where the corrugations touch and define a plurality of smaller tubes spaced peripherally around and extending longitudinally of each heat exchange tube.

27. An apparatus according to claim 1 in which said heat exchange tubes are corrugated to a depth where the corrugations touch and define a plurality of smaller tubes spaced peripherally around and extending longitudinally of each heat exchange tube, and including means for preventing fluid flow laterally around or across said tubes and confining fluid flow to a direction linearly of said tubes.

28. An apparatus according to claim 1 in which said heat exchange tubes are corrugated to a depth where the corrugations touch and define a plurality of smaller tubes spaced peripherally around and extending longitudinally of each heat exchange tube, and including means for preventing fluid flow laterally around or across said tubes and confining fluid flow to a direction linearly of said tubes, said fluid flow preventing and confining means comprising the tight nesting of the tubes along the longitudinal corrugations thereof.

29. A method of cooling water which comprises passing water and a refrigerant countercurrently through a heat exchange apparatus as defined in any of the preceeding claims with the water passing from said closed end inlet to said closed end outlet and the refrigerant passing from said shell inlet to said shell outlet.

* * * * *